US012262832B1

(12) United States Patent
Lipps, Jr.

(10) Patent No.: US 12,262,832 B1
(45) Date of Patent: Apr. 1, 2025

(54) PACKAGE DELIVERY STRONGBOX

(71) Applicant: Tommy C. Lipps, Jr., Las Vegas, NV (US)

(72) Inventor: Tommy C. Lipps, Jr., Las Vegas, NV (US)

( * ) Notice: Subject to any disclaimer, the term of this patent is extended or adjusted under 35 U.S.C. 154(b) by 154 days.

(21) Appl. No.: 18/079,290

(22) Filed: Dec. 12, 2022

(51) Int. Cl.
*A47G 29/20* (2006.01)

(52) U.S. Cl.
CPC ..... *A47G 29/20* (2013.01)

(58) Field of Classification Search
CPC ..... A47G 29/141; A47G 29/20; A47G 2029/144; B65D 7/26; B65D 9/14; B65D 15/24; B65D 21/086; B65D 11/1853
See application file for complete search history.

(56) References Cited

U.S. PATENT DOCUMENTS

| | | | | |
|---|---|---|---|---|
| 5,624,071 | A * | 4/1997 | Sosan | A47G 29/20 232/29 |
| 7,175,071 | B1 | 2/2007 | Slagle et al. | |
| 7,246,738 | B2 | 7/2007 | Jonas | |
| 9,364,112 | B2 | 6/2016 | Sundaresan | |
| 10,131,478 | B2 | 11/2018 | Maser | |
| 10,383,471 | B1 | 8/2019 | Barnes et al. | |
| 10,743,694 | B2 | 8/2020 | Raphael et al. | |
| 10,769,875 | B2 | 9/2020 | Arellano et al. | |
| 10,786,103 | B2 * | 9/2020 | Teoh | B65D 11/1853 |
| 10,881,235 | B1 | 1/2021 | Vasquez et al. | |
| 11,109,705 | B2 * | 9/2021 | Raphael | A47G 29/141 |
| 11,399,649 | B2 * | 8/2022 | Raphael | A47G 29/20 |
| 11,510,517 | B2 * | 11/2022 | McLean | B65D 11/1853 |
| 11,896,150 | B2 * | 2/2024 | Chiappetta | A47G 29/20 |
| 12,029,339 | B2 * | 7/2024 | Abderrazak | A47G 29/22 |
| 12,178,344 | B2 * | 12/2024 | Redford | A47G 29/20 |
| 2019/0225375 | A1 * | 7/2019 | Sena | A47G 29/20 |

(Continued)

FOREIGN PATENT DOCUMENTS

JP H08733 U * 4/1996

OTHER PUBLICATIONS

Boxillion Smart Parcel Box w/ WiFi, Bluetooth. Product Listing [online]. © Copyright 2022 Iphoneness [retrieved on Apr. 22, 2022]. Retrieved from the Internet <URL: https://www.iphoneness.com/news/boxillion/>.

(Continued)

*Primary Examiner* — William L Miller
(74) *Attorney, Agent, or Firm* — Cramer Patent & Design PLLC; Aaron R. Cramer

(57) ABSTRACT

The present invention is directed to a package delivery strongbox. The package delivery strongbox may comprise a strongbox, a first shutter, a second shutter, and a latching mechanism. The strongbox may couple to the outside of an exterior door via the first shutter and the second shutter. The strongbox may be adapted for a delivery person to place one or more delivered packages into the strongbox through an open top and then close a lid. The latching mechanism may engage the lid thereby securing the one or more delivered packages inside of the strongbox. The one or more delivered packages may be removed by opening the exterior door, moving the first shutter and the second shutter to release the latching mechanism, and opening the lid. The strongbox may collapse for storage by folding the strongbox at a plurality of hinges.

18 Claims, 6 Drawing Sheets

(56) References Cited

U.S. PATENT DOCUMENTS

| | | | | |
|---|---|---|---|---|
| 2019/0350398 | A1* | 11/2019 | Raphael | A47G 29/141 |
| 2020/0237946 | A1* | 7/2020 | Shell | A61L 2/28 |
| 2021/0127880 | A1* | 5/2021 | Raphael | A47G 29/141 |
| 2021/0355741 | A1* | 11/2021 | Chiappetta | A47G 29/20 |
| 2022/0257041 | A1* | 8/2022 | Redford | B65D 11/186 |
| 2022/0267048 | A1* | 8/2022 | Rogers | A47G 29/30 |
| 2023/0157472 | A1* | 5/2023 | Barkman | A47G 29/20<br>232/1 R |
| 2024/0090693 | A1* | 3/2024 | Courtney | A47G 29/141 |

OTHER PUBLICATIONS

Full Service Vault. Product Listing [online]. © dVault ® Company, Inc. [retrieved on Apr. 22, 2022]. Retrieved from the Internet <URL: https://www.dvault.com/locking-package-mailboxes/full-service-vault-dvcs0015/>.

Secure Your Deliveries with the Package Bench. Product Listing [online]. Pinterest.com [retrieved on Apr. 22, 2022]. Retrieved from the Internet <URL: https://www.etsy.com/listing/653336912/secure-your-deliveries-with-the-package?show_sold_out_detail=1&ref=nla_listing_details>.

* cited by examiner

PACKAGE DELIVERY STRONGBOX

RELATED APPLICATIONS

None.

FIELD OF THE INVENTION

The present invention relates generally to a package delivery receptacle and more specifically to a package delivery secured receptacle or strongbox.

BACKGROUND OF THE INVENTION

In the typical business day, millions of parcels and items are delivered around the world. While computerized tracking, customer databases, and electronic scanning has greatly increased productivity and reduced mistakes, one weak link remains the final delivery point, as large packages are often simply left on front porches and doors of unattended residences and businesses. It is often simply not possible to be present when a package is delivered anymore, as many locations often receive several packages a day.

Unfortunately, the criminal element is always present and such packages are often simply stolen. Package theft is an epidemic, and costs shippers, carriers, and customers several billion dollars annually. Accordingly, there exists a need for a means by which large and oversize parcels can be safely and securely delivered to the intended recipient with reduced opportunity for theft without the recipient being present. The development of the package delivery strongbox fulfills this need.

SUMMARY OF THE INVENTION

To achieve the above and other objectives, the present invention provides for a package delivery strongbox having a strongbox which in turn has an open top and a close lid, the strongbox is adapted to a delivery person to place one or more delivered packages into the strongbox through the open top and the close lid, a first shutter coupling the strongbox to the outside of an exterior door via the first shutter, a second shutter coupling the strongbox to the outside of the exterior door via the second shutter, and a latching mechanism engaging the close lid thereby securing the one or more delivered packages inside of the strongbox.

The one or more delivered packages may be removed by opening the exterior door, moving the first shutter and the second shutter to release the latching mechanism, and opening the close lid. The strongbox may collapse for storage by folding the strongbox at a plurality of hinges. The strongbox may be an enclosure having a front wall, a rear wall, a left side wall, a right-side wall, the close lid, and a bottom wall. The front wall may hingedly couple to the left side wall via a plurality of left front wall hinges. The front wall may hingedly couple to the right-side wall via a plurality of right front wall hinges.

The rear wall may hingedly couple to the left side wall via a plurality of left rear wall hinges. The rear wall may hingedly couple to the right-side wall via a plurality of right rear wall hinges. The close lid may hingedly couple to the front wall via a plurality of lid hinges. The bottom wall may hingedly couple to the rear wall via a plurality of bottom wall hinges. The bottom wall may pivot to a position that places the bottom wall between and perpendicular to the bottoms of the front wall, the rear wall, the left side wall, and the right-side wall. The close lid may pivot to a position that places the close lid between and perpendicular on tops of the front wall, the rear wall, the left side wall, and the right-side wall.

The package delivery receptacle may have an individual side wall selected from the left side wall and the right-side wall are separated into a front half panel and a rear half panel.

The front half panel hingedly may be coupled to the rear half panel such that the individual side wall may fold in half. The center of the left side wall may hinge inward at a vertical line via a plurality of left wall hinges and the center of the right-side wall hinge inward at a vertical line via a plurality of right wall hinges. The rear wall may include a shutter aperture that passes through the rear wall from front to rear and a shutter slot passing laterally through the rear wall.

The close lid may include a pair of latch catches located on the rear underside of the close lid. The pair of latch catches may be operable to engage a pair of opposing latches located on the latching mechanism in order to hold the close lid in a closed position. A distal end of the first shutter may include a U-shaped bracket that wraps around an end of a knob side of the exterior door. A distal end of the second shutter may include an L-shaped bracket that touches the end of a hinge side of the exterior door.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 7A is a detail view of the latching mechanism of FIG. 7, according to an embodiment of the present invention;

DESCRIPTIVE KEY

Figure 1:
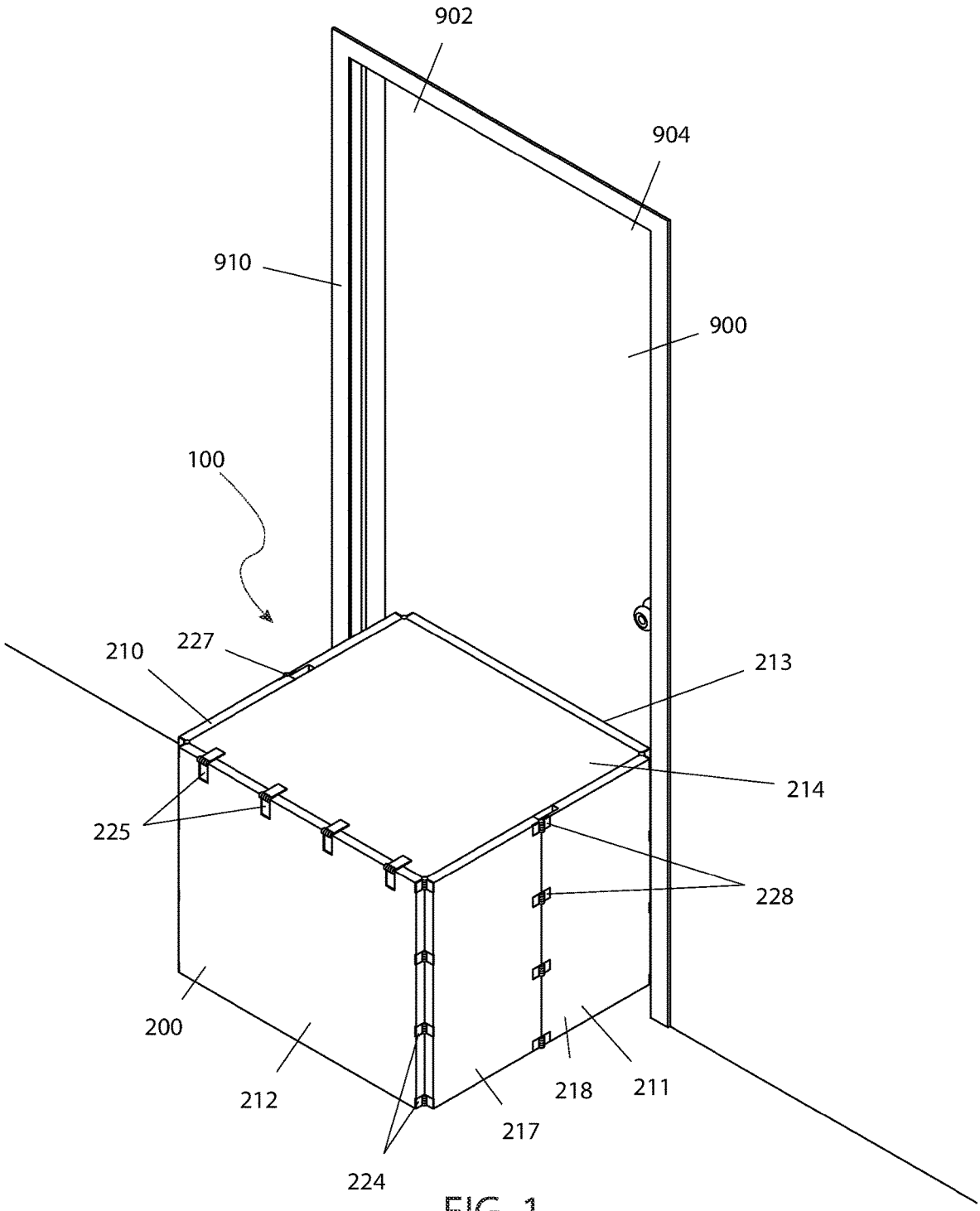
FIG. 1 is an isometric in-use view of a package delivery strongbox, according to an embodiment of the present invention, illustrating the lid closed.
Figure 2:
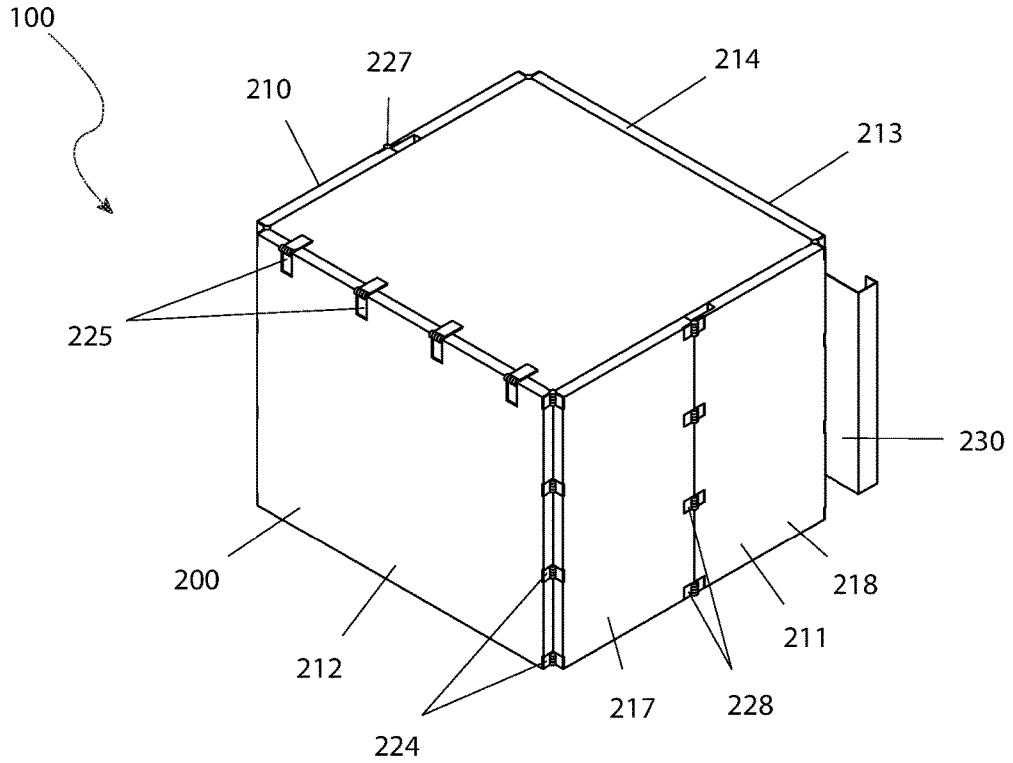
FIG. 2 is an isometric view of a package delivery strongbox, according to an embodiment of the present invention.
Figure 3:
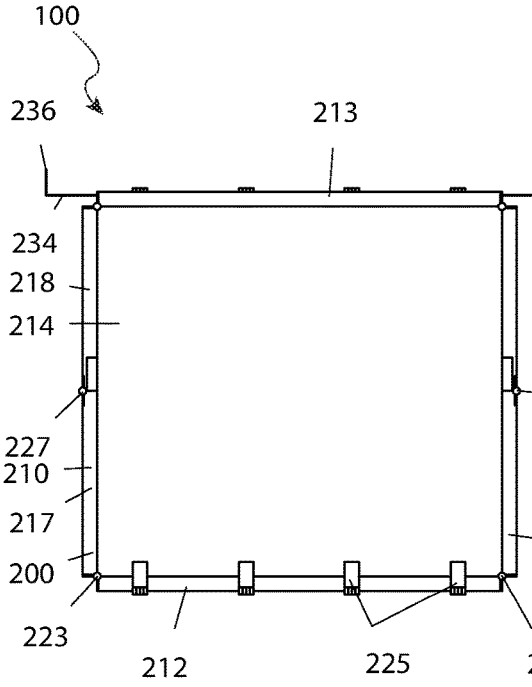
FIG. 3 is a top view of a package delivery strongbox, according to an embodiment of the present invention.
Figure 4:
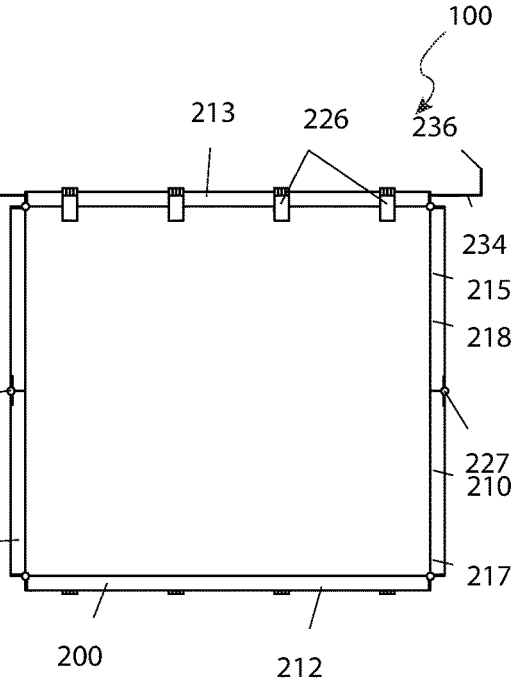
FIG. 4 is a bottom view of a package delivery strongbox, according to an embodiment of the present invention.
Figure 5:
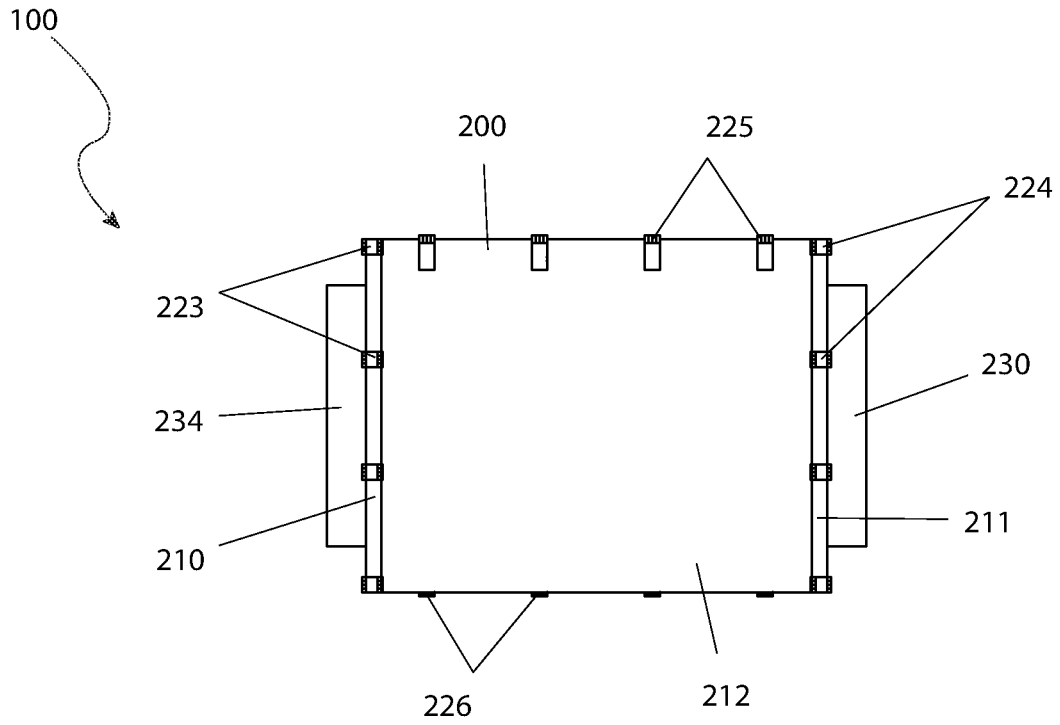
FIG. 5 is a rear view of a package delivery strongbox, according to an embodiment of the present invention.
Figure 6:
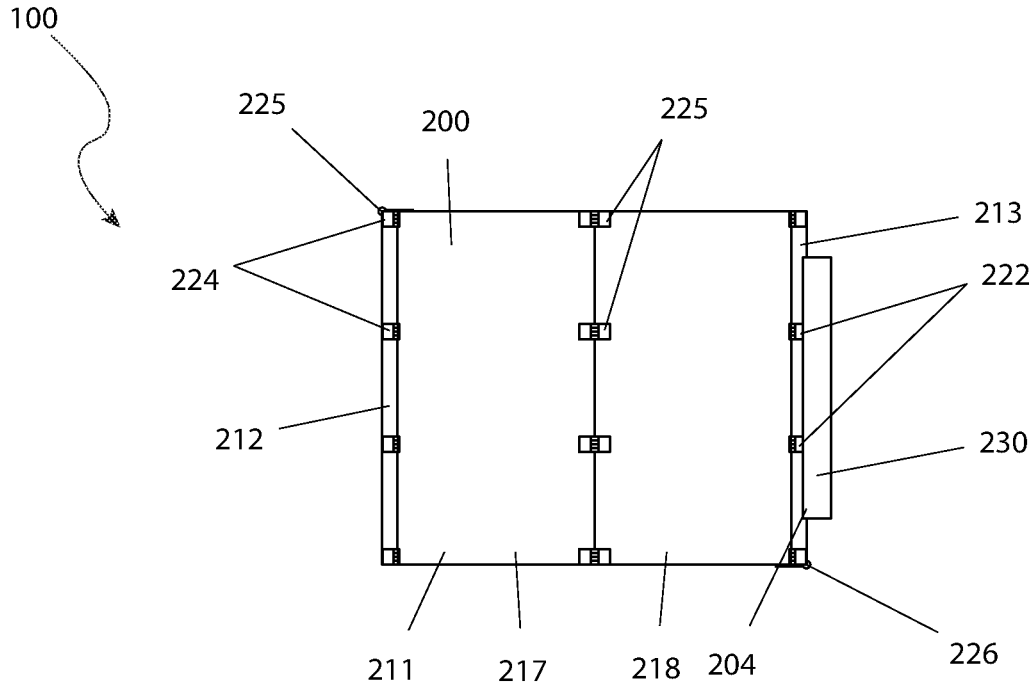
FIG. 6 is a side view of a package delivery strongbox, according to an embodiment of the present invention.
Figure 7:
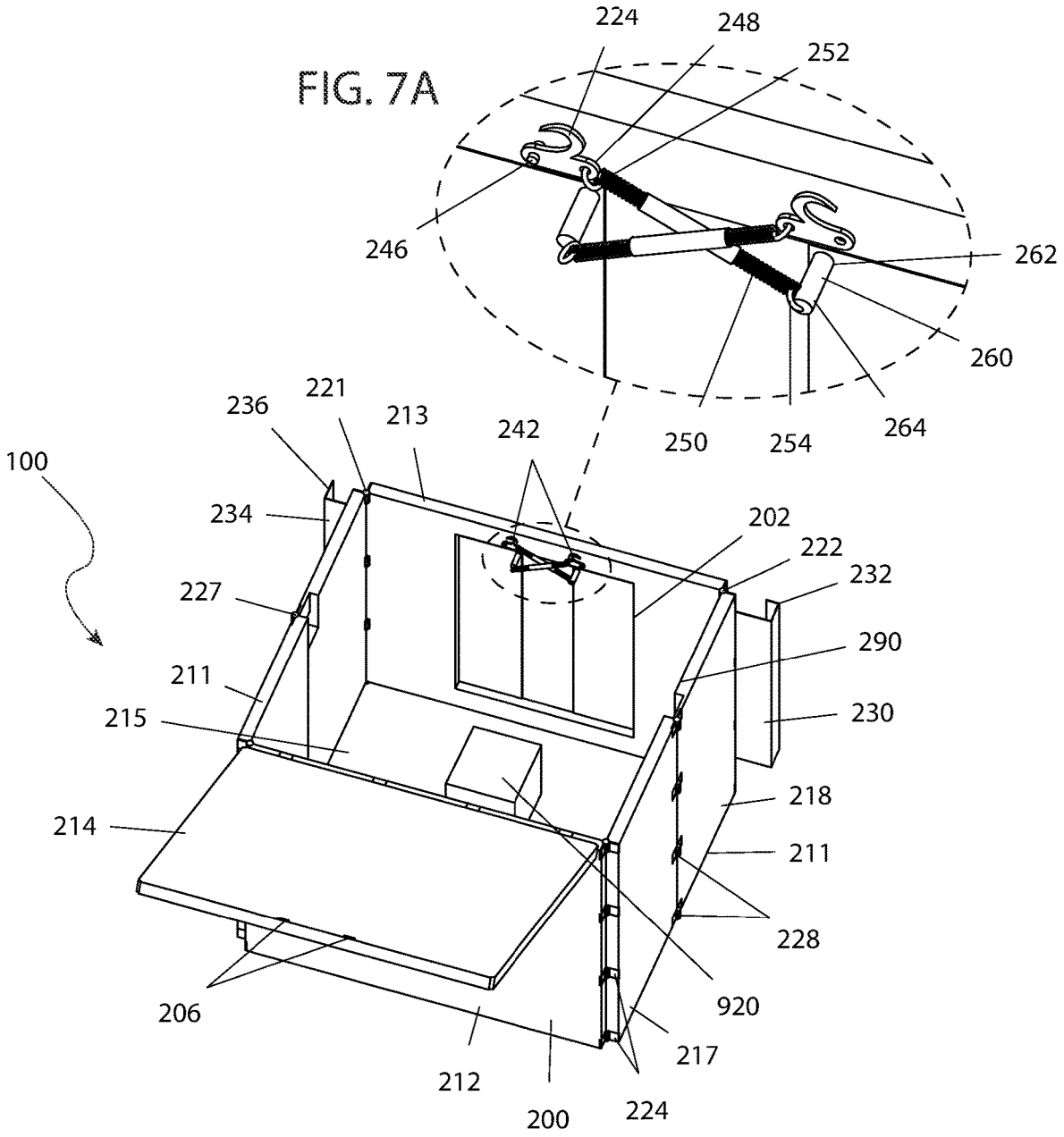
FIG. 7 is an isometric view of a package delivery strongbox, according to an embodiment of the present invention, illustrating the lid open.
Figure 8:
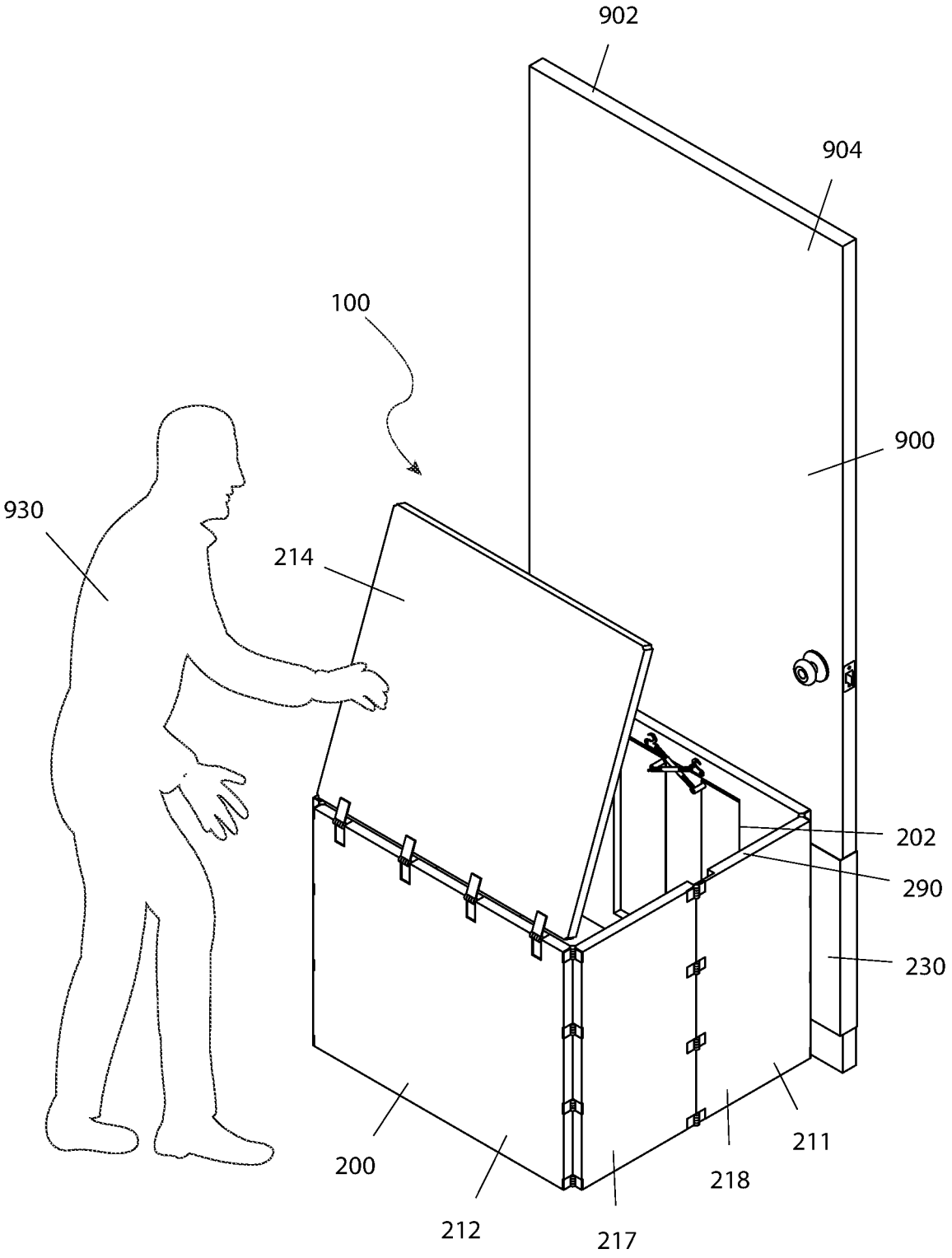
FIG. 8 is an in-use view of a package delivery strongbox, according to an embodiment of the present invention.

100 package delivery strongbox
200 strongbox
202 shutter aperture
204 shutter slot
206 latch catch
210 left side wall
211 right side wall
212 front wall

213 rear wall
214 lid
215 bottom wall
217 front half panel
218 rear half panel
221 left rear wall hinge
222 right rear wall hinge
223 left front wall hinge
224 right front wall hinge
225 lid hinge
226 bottom wall hinge
227 left wall hinge
228 right wall hinge
230 first shutter
232 U-shaped bracket
234 second shutter
236 L-shaped bracket
242 latch
244 hook
246 hook pivot
248 hook spring aperture
250 spring
252 first spring end
254 second spring end
260 shutter standoff
262 first standoff end
264 second standoff end
290 open top
900 exterior door
902 hinge side
904 knob side
910 door frame
920 delivered package
930 delivery person

DESCRIPTION OF THE INVENTION

The present invention is directed to a package delivery strongbox (herein described as the "invention") 100. The invention 100 may comprise a strongbox 200, a first shutter 230, a second shutter 234, and a latching mechanism. The strongbox 200 may couple to the outside of an exterior door 900 via the first shutter 230 and the second shutter 234. The strongbox 200 may be adapted for a delivery person 930 to place one (1) or more delivered packages 920 into the strongbox 200 through an open top 290 and then close a lid 214. The latching mechanism may engage the lid 214 thereby securing the any delivered package 920 inside of the strongbox 200. Any delivered packages 920 may be removed by opening the exterior door 900, moving the first shutter 230 and the second shutter 234 to release the latching mechanism, and opening the lid 214. The strongbox 200 may collapse for storage by folding the strongbox 200 at a plurality of hinges.

The strongbox 200 may be an enclosure comprising a front wall 212, a rear wall 213, a left side wall 210, a right side wall 211, the lid 214, and a bottom wall 215. The front wall 212 may hingedly couple to the left side wall 210 via a plurality of left front wall hinges 223. The front wall 212 may hingedly couple to the right side wall 211 via a plurality of right front wall hinges 224. The rear wall 213 may hingedly couple to the left side wall 210 via a plurality of left rear wall hinges 221. The rear wall 213 may hingedly couple to the right side wall 211 via a plurality of right rear wall hinges 222.

The lid 214 may hingedly couple to the front wall 212 via a plurality of lid hinges 225. The bottom wall 215 may be hingedly coupled to the rear wall 213 via a plurality of bottom wall hinges 226. The bottom wall 215 may pivot to a position that places the bottom wall 215 between and perpendicular to the bottoms of the front wall 212, the rear wall 213, the left side wall 210, and the right side wall 211. The lid 214 may pivot to a position that places the lid 214 between and perpendicular to the tops of the front wall 212, the rear wall 213, the left side wall 210, and the right side wall 211.

An individual side wall selected from the left side wall 210 and the right side wall 211 may be separated into a front half panel 217 and a rear half panel 218. The front half panel 217 may be hingedly coupled to the rear half panel 218 such that the individual side wall may fold in half. The center of the left side wall 210 may hinge inward at a vertical line via a plurality of left wall hinges 227. The center of the right side wall 211 may hinge inward at a vertical line via a plurality of right wall hinges 228.

Figure 9:
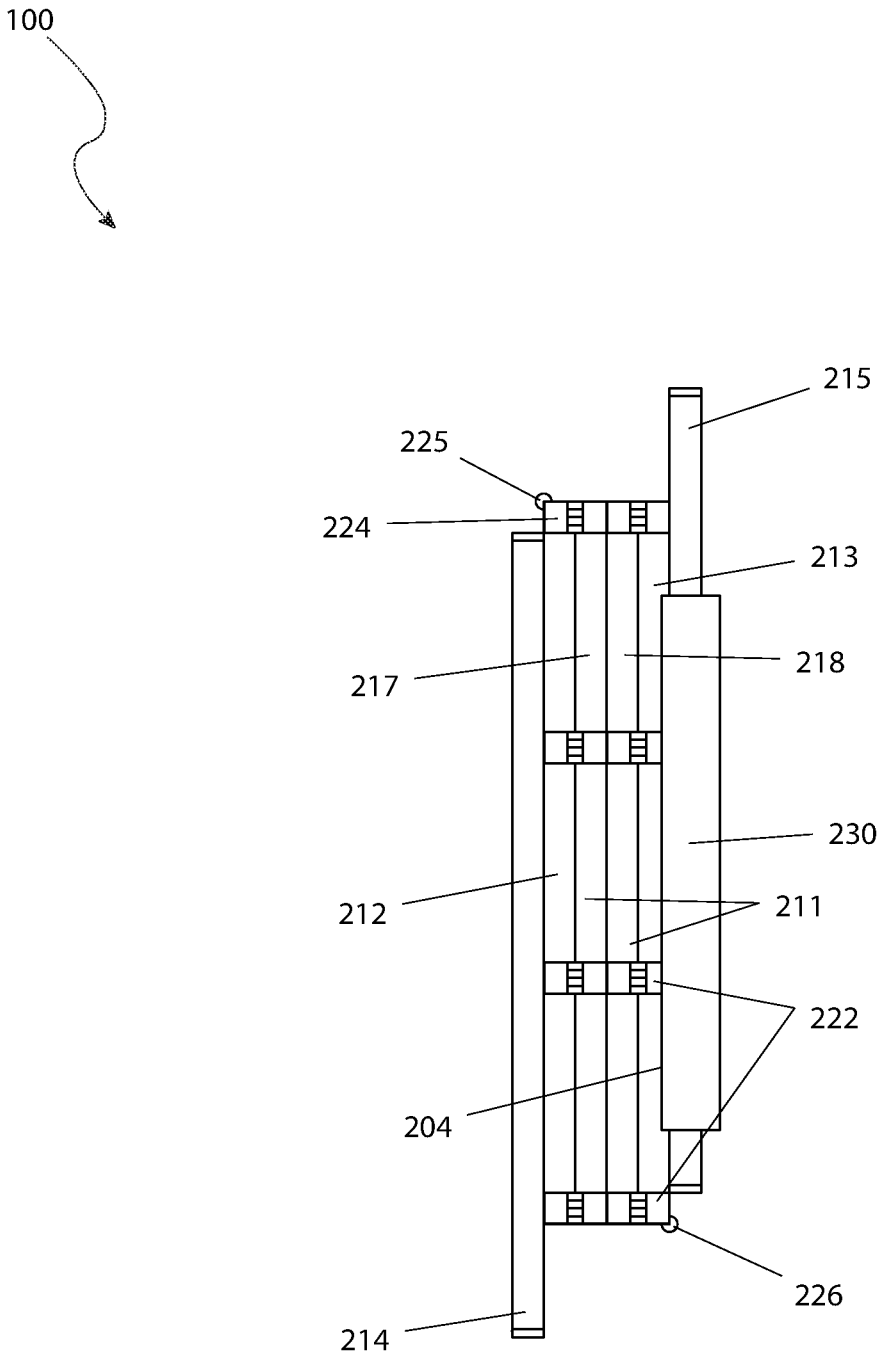
FIG. 9 is a side view of a package delivery strongbox, according to an embodiment of the present invention, illustrating the collapsed storage configuration.

The strongbox 200 may collapse for storage by hinging the centers of the left side wall 210 and the right side wall 211 inward while simultaneously moving the front wall 212 towards the rear wall 213 and by hinging the lid 214 and the bottom wall 215 maximally open such that the lid 214, the bottom wall 215, the front wall 212, the rear wall 213 are parallel to each other as shown in FIG. 9.

The rear wall 213 may comprise a shutter aperture 202 that passes through the rear wall 213 from front to rear. The shutter aperture 202 may provide clearance for shutter standoffs 260 on the first shutter 230 and the second shutter 234 to move laterally. The rear wall 213 may further comprise a shutter slot 204 passing laterally through the rear wall 213. The first shutter 230 and the second shutter 234 may slide laterally within the shutter slot 204.

The lid 214 may comprise a pair of latch catches 206 located on the rear underside of the lid 214. The pair of latch catches 206 may be operable to engage a pair of opposing latches 242 located on the latching mechanism in order to hold the lid 214 in a closed position. As a non-limiting example, the pair of latch catches 206 may be a pair of latch slots.

The bottom wall 215 may prevent the left side wall 210 and the right side wall 211 from folding inward when the bottom wall 215 is positioned between the bottoms of the front wall 212, the rear wall 213, the left side wall 210, and the right side wall 211.

As a non-limiting example, the strongbox 200 may be made of rigid plastic. The first shutter 230 and the second shutter 234 may couple the strongbox 200 to the exterior door 900 when the exterior door 900 is open such that the strongbox 200 may be immovable when the exterior door 900 is closed. The first shutter 230 and the second shutter 234 may extend laterally from opposite sides of the rear wall 213 and may grip opposite sides of the exterior door 900. The first shutter 230 and the second shutter 234 may slide within the rear wall 213 in order to match the width of the exterior door 900. The distal end of the first shutter 230 may comprise a U-shaped bracket 232. The U-shaped bracket 232 may wrap around the end of a knob side 904 of the exterior door 900. The distal end of the second shutter 234 may comprise an L-shaped bracket 236. The L-shaped bracket 236 may touch the end of a hinge side 902 of the exterior door 900.

The U-shaped bracket 232 and the L-shaped bracket 236 may be captured between the exterior door 900 and a door frame 910 when the exterior door 900 is closed. The exterior door 900 may prevent the first shutter 230 and the second shutter 234 from moving towards each other and the door frame 910 may prevent the first shutter 230 and the second shutter 234 from away from each other. Friction with the exterior door 900 and the door frame 910 may prevent the first shutter 230 and the second shutter 234 from moving up and down. The exterior door 900 and the door frame 910 may prevent the first shutter 230 and the second shutter 234 from moving forward or rearward. With the first shutter 230 and the second shutter 234 immobilized by the exterior door 900 and the door frame 910, the strongbox 200 is likewise immobilized.

In some embodiments, the positions of the first shutter 230 and the second shutter 234 may be reversible to accommodate both left-hand doors and right-hand doors. The latching mechanism may comprise the pair of opposing latches 242 that may engage the pair of latch catches 206 on the lid 214 and may retain the lid 214 in the closed position. The pair of opposing latches 242 may pivot as the lid 214 is closed such that hooks 244 on the pair of opposing latches 242 may engage the pair of latch catches 206. Once the hooks 244 are engaged, the hooks 244 may prevent the lid 214 from opening until the first shutter 230 and the second shutter 234 are moved laterally. Moving the first shutter 230 and the second shutter 234 laterally may require that the exterior door 900 be unlocked and opened.

An individual latch selected from the pair of opposing latches 242 may comprise the hook 244, a spring 250, and the shutter standoff 260. The hook 244 may be a C-shaped armature that may be pivotably coupled to the rear wall 213 at a hook pivot 246. The hook 244 may comprise a hook spring aperture 248 for coupling the spring 250 to the hook 244. The spring 250 may retain the hook 244 in position that prevents the lid 214 from opening while allowing the hook 244 to pivot in order to close the lid 214.

The shutter standoff 260 may be located on an individual shutter that is on the opposite side of center from the hook 244. As a non-limiting example, for the hook 244 that is mounted on the left side of center, the spring 250 couples the hook 244 to the shutter standoff 260 that is coupled to the individual shutter on the right side of the rear wall 213. A first spring end 252 may be coupled to the hook 244 at the hook spring aperture 248. A second spring end 254 may be coupled to the shutter standoff 260.

The shutter standoff 260 may be coupled to the top centermost corner of the individual shutter. A first standoff end 262 may be coupled to the individual shutter. The shutter standoff 260 may extend forward into the strongbox 200. A second standoff end 264 may couple to the spring 250. Sliding the individual shutter may pivot the hook 244 and may release the lid 214.

In use, the strongbox 200 may be unfolded by separating the front wall 212 and the rear wall 213 while straightening the left side wall 210 and the right side wall 211. The bottom wall 215 may be pivoted to a position beneath the strongbox 200 and may be placed between the bottoms of the front wall 212, the rear wall 213, the left side wall 210, and the right side wall 211 to keep the strongbox 200 from folding. The lid 214 may be pivoted forward to open the strongbox 200. The exterior door 900 may be opened and the strongbox 200 may be positioned against the exterior door 900 where the first shutter 230 and the second shutter 234 may extend around the sides of the exterior door 900. With the U-shaped bracket 232 engaging the knob side 904 of the exterior door 900 and the L-shaped bracket 236 engaging the hinge side 902 of the exterior door 900, the exterior door 900 may be closed and locked.

The delivery person 930 may place any delivered package 920 into the strongbox 200 and close the lid 214. As the lid 214 closed, the hooks 244 on the pair of opposing latches 242 may pivot and may engage the pair of latch catches 206 on the lid 214 to hold the lid 214 closed. A user may remove any delivered package 920 from the strongbox 200 by unlocking the exterior door 900, opening the exterior door 900, sliding the first shutter 230 and the second shutter 234 to disengage the hooks 244 from the pair of latch catches 206, and pivoting the lid 214 open.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A package delivery receptacle, comprising:

a strongbox having an open top and a close lid, the strongbox is adapted to a delivery person to place one or more delivered packages into the strongbox through the open top and the close lid;

a first shutter coupling the strongbox to the outside of an exterior door via the first shutter;

a second shutter coupling the strongbox to the outside of the exterior door via the second shutter; and a latching mechanism engaging the close lid thereby securing the one or more delivered packages inside of the strongbox; and, wherein the first shutter and the second shutter each include a shutter standoff with a first standoff end coupled to a respective shutter and a second standoff end coupled to a spring;

wherein the shutters are adapted to slide laterally within a shutter slot passing through the strongbox; and, wherein a movement of the first and the second shutters causes the shutter standoffs to pivot a pair of hooks on the latching mechanism, thereby disengaging the hooks from a pair of latch catches disposed on a rear underside of the close lid, thereby allowing the close lid to be opened.

2. The package delivery receptacle, according to claim 1, wherein the strongbox collapses for storage by folding the strongbox at a plurality of hinges.

3. The package delivery receptacle, according to claim 1, wherein the strongbox is an enclosure having a front wall, a rear wall, a left side wall, a right-side wall, the close lid, and a bottom wall.

4. The package delivery receptacle, according to claim 3, wherein the front wall hingedly couples to the left side wall via a plurality of left front wall hinges.

5. The package delivery receptacle, according to claim 3, wherein the front wall hingedly couples to the right-side wall via a plurality of right front wall hinges.

6. The package delivery receptacle, according to claim 3, wherein the rear wall hingedly couples to the left side wall via a plurality of left rear wall hinges.

7. The package delivery receptacle, according to claim 3, wherein the rear wall hingedly couples to the right-side wall via a plurality of right rear wall hinges.

8. The package delivery receptacle, according to claim 3, wherein the close lid hingedly couples to the front wall via a plurality of lid hinges.

9. The package delivery receptacle, according to claim 3, wherein the bottom wall hingedly coupled to the rear wall via a plurality of bottom wall hinges.

10. The package delivery receptacle, according to claim 3, wherein the bottom wall pivots to a position that places the bottom wall between and perpendicular to a bottom of each of the front wall, the rear wall, the left side wall, and the right-side wall.

11. The package delivery receptacle, according to claim 3, wherein the close lid pivots to a position that places the close lid between and perpendicular on a top of each of the front wall, the rear wall, the left side wall, and the right-side wall.

12. The package delivery receptacle, according to claim 3, wherein an individual side wall selected from the left side wall and the right-side wall is separated into a front half panel and a rear half panel.

13. The package delivery receptacle, according to claim 12, wherein the front half panel is hingedly coupled to the rear half panel such that the individual side wall may fold in half.

14. The package delivery receptacle, according to claim 3, wherein the center of the left side wall hinges inward at a vertical line via a plurality of left wall hinges and the center of the right-side wall hinge inward at a vertical line via a plurality of right wall hinges.

15. The package delivery receptacle, according to claim 3, wherein the rear wall includes a shutter aperture that passes through the rear wall from front to rear and the shutter slot passing laterally through the rear wall.

16. The package delivery receptacle, according to claim 1, wherein the pair of latch catches are operable to engage a pair of opposing latches located on the latching mechanism in order to hold the close lid in a closed position.

17. The package delivery receptacle, according to claim 1, wherein a distal end of the first shutter includes a U-shaped bracket that wraps around an end of a knob side of the exterior door.

18. The package delivery receptacle, according to claim 1, wherein a distal end of the second shutter includes an L-shaped bracket that touches an end of a hinge side of the exterior door.

* * * * *